United States Patent [19]

Nelson

[11] 4,322,266

[45] Mar. 30, 1982

[54] PROCESS FOR CATALYZING REDUCTION IN A KRAFT RECOVERY BOILER

[75] Inventor: Hugh W. Nelson, West Hartford, Conn.

[73] Assignee: Combustion Engineering, Inc., Windsor, Conn.

[21] Appl. No.: 228,450

[22] Filed: Jan. 26, 1981

Related U.S. Application Data

[63] Continuation of Ser. No. 86,231, Oct. 18, 1979, abandoned, which is a continuation-in-part of Ser. No. 956,558, Nov. 1, 1978, abandoned.

[51] Int. Cl.[3] ..... D21C 11/04; D21C 11/12

[52] U.S. Cl. ..... 162/30 K; 423/207; 423/561 A; 423/DIG. 3

[58] Field of Search ..... 423/207, 561 A, DIG. 3; 162/30 R, 30 K, 32

[56] References Cited

PUBLICATIONS

Whitney (Editor), Chemical Recovery in Alkaline Pulping Processes, Tappi Monograph #32, 1968, pp. 59, 60, 115–117.

Birk et al. "Hydrogen Reduction of Alkali Sulfate", Ind. Eng. Chem. vol. 10, No. 1, 1971, pp. 7–13.

*Primary Examiner*—Peter F. Kratz

*Attorney, Agent, or Firm*—Wayne H. Lang; William W. Habelt

[57] ABSTRACT

A Kraft pulping process by which spent pulping liquor is burned in a recovery furnace 12 to reduce inactive alkali sulfates therein to active alkali sulfides while producing molten smelt that when added to water forms green liquor and residual dregs bearing catalytic iron. The dregs are separated from the green liquor and divided into first and second portions. The first portion of the dregs is discarded while the second portion of dregs required to maintain a concentration of iron in the smelt at from 0.05% to 5% is recirculated back to the furnace to provide optimum catalytic reduction of alkali sulfates to alkali sulfides. A quantity of alkali metal compounds is added at 24 to the pulping liquor in line 10 to serve as a temperature depressor that, together with the co-addition of said dregs, lowers the temperature of the molten smelt in furnace 12 from approximately 800° C. to a more favorable temperature of about 650° C. where maximum reduction of alkali sulfates to alkali sulfides will occur.

5 Claims, 1 Drawing Figure

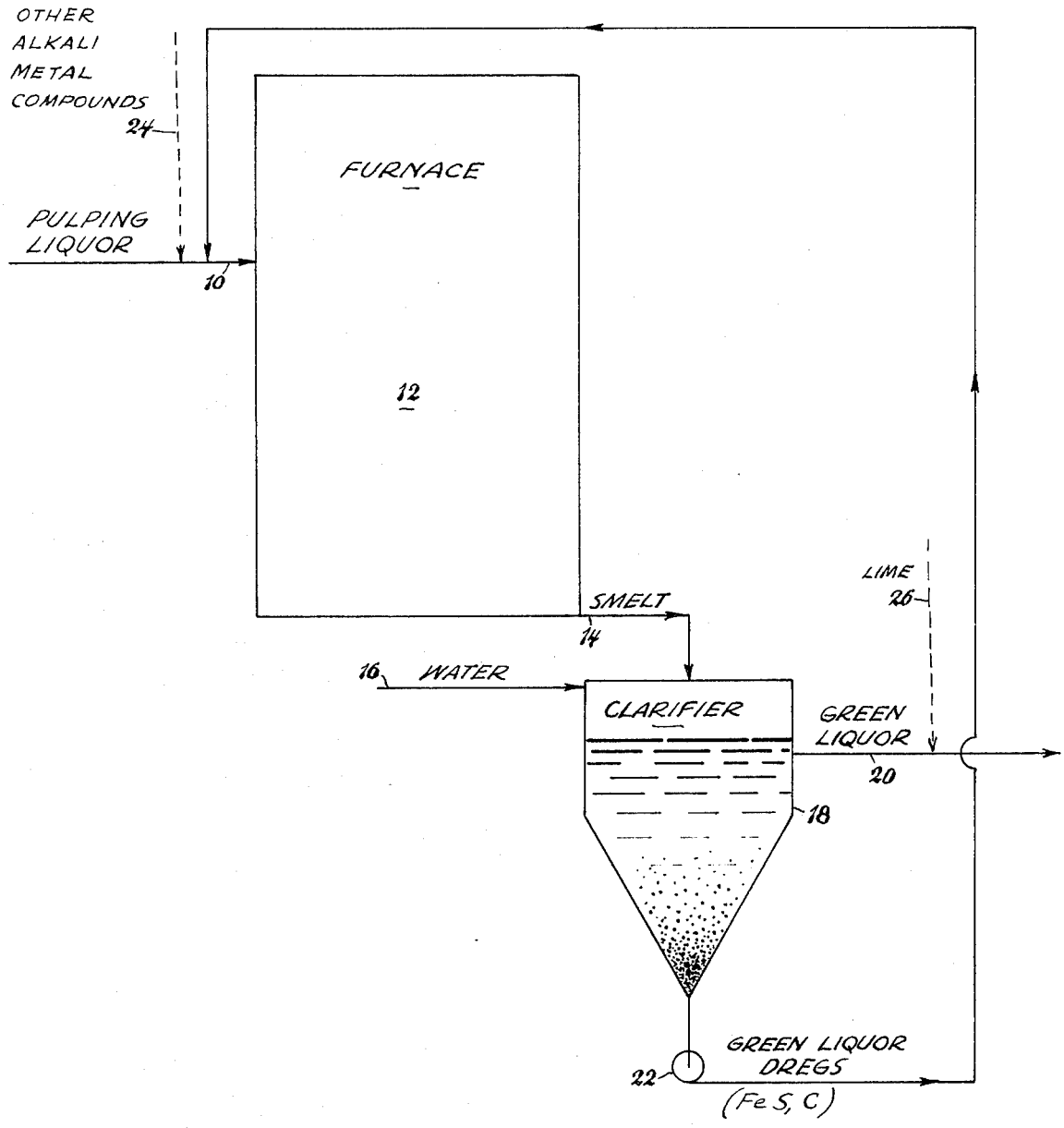
OTHER
ALKALI
METAL
COMPOUNDS
24
FURNACE
PULPING
LIQUOR
10
12
LIME
26
SMELT
14
16
WATER
CLARIFIER
GREEN
LIQUOR
20
18
GREEN LIQUOR
DREGS
22
(Fe S, C)

PROCESS FOR CATALYZING REDUCTION IN A KRAFT RECOVERY BOILER

This application is a continuation of application Ser. No. 86,231, filed Oct. 18, 1979, now abandoned, which is a continuation-in-part of application Ser. No. 956,558, filed Nov. 1, 1978, and now abandoned, the filing date of which is hereby claimed under 35 USC 120 for the subject matter common therewith.

FIELD OF THE INVENTION

This invention relates to a Kraft recovery process used in producing pulp from wood. In this process, inactive sodium sulfate present in pulping liquor must be reduced to sodium sulfide before it can be used in the recovery process. Efficiency of reduction is governed by a number of operating variables such as bed burning temperature, char bed depth, percent of solids in the spent pulping liquor, and proportion of primary air used. Low reduction efficiency often necessitates the expensive operation of adding extra lime to the pulping liquor in a process known as "causticizing."

It has been shown conclusively in a paper ("Hydrogen Reduction of an Alkali Sulfate" by J. R. Birk, C. M. Larson, W. G. Vaux and R. D. Oldenkamp, Ind. Eng. Chem. Process Des. Develop., Vol. 10, No. 1, 1971, pp. 7–13) that iron compounds, especially iron sulfide (FeS), catalyzed the hydrogen reduction of alkali sulfates to sulfides to an important extent, 560% at 1112° F. The catalytic action of iron was found to decrease with increasing temperature and to become substantially inactive about 800° C. (1472° F.).

SUMMARY OF THE INVENTION

The present invention is accordingly directed to a chemical recovery process by which an iron catalyst is added to spent black liquor from a chemical recovery process in advance of a recovery furnace whereby inactive sodium sulfate contained therein is more effectively reduced by carbon (instead of hydrogen) to active sodium sulfide through the addition of an iron catalyst.

It has been discovered that caustic pulping liquor circulating through the pulping system continuously picks up iron from the surrounding tanks, piping, digesters and furnace walls. Most of this iron precipitates as "dregs" containing insoluble ferrous sulfide and carbon when residual smelt from a recovery process is added to water to form green liquor. A portion of these iron rich dregs is recycled back to the system in advance of the recovery furnace to serve as the iron catalyst that increases the rate of reducing inactive sodium sulfate to active sodium sulfide.

Inasmuch as the temperature of smelt being exhausted from a recovery furnace normally varies over a narrow range from 810° C. to 820° C., the addition of an iron catalyst to the molten smelt would normally have no beneficial effect upon the rate of reduction of alkali sulfate to alkali sulfide. This is essentially true because the catalytic effect of iron on the rate of reducing alkali sulfates to alkali sulfides is at a maximum at about 650° C. and decreases with increasing temperature to zero activity at about 810° C. to 820° C.

A melting point depressor is, therefore, added to the spent pulping liquor in advance of the recovery furnace to lower the temperature of the molten smelt exhausting therefrom to a catalytically much more favorable temperature of approximately 650° C.

BRIEF DESCRIPTION OF THE DRAWING

The single FIGURE of the drawing diagrammatically represents that portion of a Kraft recovery process employed in the present invention.

DESCRIPTION OF A PREFERRED EMBODIMENT

The present invention relates to a Kraft process for pulping wood wherein wood chips are digested in a water solution of sodium hydroxide and sodium sulfide known as "white liquor." Spent or used digesting liquor is separated from the resulting pulp and the pulp is then further refined as necessary for eventual use. The recovered liquor known as "black liquor" being exhausted from the digester contains some organic matter extracted from the wood chips together with other chemicals not consumed in the digestion process according to standard pulping procedure.

The black liquor is concentrated and then injected back into the chemical recovery furnace where the organic content is burned and sodium sulfate thereof reduced to sodium sulfide.

A molten ash or smelt is discharged therefrom into a quantity of water to form "green liquor" that is clarified and circulated further for use in the pulping process.

The "green liquor" contains sodium carbonate, sodium sulfide and other salts along with a small quantity of finely divided material commonly known as green liquor "dregs" that precipitate when the smelt is added to water. The "dregs" include some ferrous sulfide together with some carbon that is carried over with the smelt.

The iron of the green liquor "dregs" normally occurs because of the continuous corrosive attack on the tubes, digesters, tanks, furnace walls, and because of the impurities present in the make-up chemicals. Most of this iron from the green liquor precipitates quickly as ferrous sulfide (FeS) when the smelt is added to water. The "dregs" also contain some carbon from char carried out of the furnace with the molten smelt. Excess dregs beyond those that are necessary for catalysis according to my invention are washed free from valuable alkali and discarded in the normal Kraft fashion.

Such "dregs" are commonly considered a waste product and are discarded entirely in a normal Kraft recovery process, because leaving them in the system would reduce lime availability to intolerable levels.

In my invention, however, I utilize a portion of the "dregs" of the green liquor to provide the iron necessary as an effective catalyst in the recovery furnace to enhance the reduction of sodium sulfate to sodium sulfide. Moreover, by injecting a temperature depressor into the spent pulping liquor before it is admitted to the recover furnace, the temperature of the smelt is maintained at an optimum level for reducing the sulfate to sulfide. Furthermore, some of the carbon of the dregs is burned to provide still another source of fuel for the recovery process.

Accordingly, spent pulping liquor that contains a quantity of inactive sodium sulfate together with residual organic matter is recirculated back into the inlet 10 of a recovery furnace 12 where some of the carbon is burned, and some of the carbon combines with oxygen of the inactive sodium sulfate to form active sodium sulfide and carbon monoxide.

Inasmuch as sodium sulfide is the active ingredient of the pulping liquor while the sodium sulfate is inactive, a high efficiency in the reduction of sodium sulfate to sodium sulfide is to be desired. An efficiency of 85% reduction of sodium sulfate to sodium sulfide is typical in an average Kraft mill, so a significant portion of inactive sodium salts remains in the pulping liquor after it has emerged from the recovery furnace. Such inactive salts are detrimental to the pulping process and are minimized in accordance with my invention.

Molten ash from the combustion of spent pulping liquor is accordingly discharged from recovery furance 12 as molten "smelt" through outlet duct 14 into a dissolving tank 17 where it is mixed with a quantity of wash water supplied through duct 34 from dregs washer 16 to form "green liquor" and a quantity of finely divided precipitate called "dregs." The "green liquor" contains essentially sodium sulfide and sodium carbonate while the "dregs" are comprised chiefly of carbon and ferrous sulfide.

The green liquor is then exhausted through a duct 32 to clarifier 18 where the "dregs" are removed therefrom, and the resulting clear green liquor is exhausted through a duct 20 to a causticizer 27. Lime added through inlet 26 converts the sodium carbonate therein to caustic soda, while excess lime precipitates and is removed from the system through outlet duct 29. The resulting fluid is the "white liquor" that is the original delignifying agent in the pulping process, and it is recirculated through duct 30 back to repeat the initial steps of a conventional Kraft process that include processing in a digester (now shown) and in a recovery furnace 12.

As the dregs are exhausted from clarifier 18, they pass through a pump 22 where they are divided, a portion being carried through duct 23 back to the spent pulping liquor of inlet 10 in advance of recovery furnace 12. The remaining portion is directed on to the washer 16 where they are accordingly washed and discarded through a duct 25 in the manner common to the Kraft pulping process.

The quantity of iron rich dregs recycled back to the recovery furnace 12 is adapted to maintain the concentration of iron in the smelt at from 0.05% to 5% calculated as $Fe_2O_3$. Periodic smelt analyses may be required to establish that the iron concentration remains within this range and the amount of recirculated "dregs" in line 23 varied by conventional valving means to maintain the proper level of iron concentration. While the iron content of the "dregs" serves to catalyze the reduction of inactive sodium sulfate to active sodium sulfide, the residual carbon of the dregs is continuously being subjected to combustion in furnace 12 and serves as an additional source of fuel.

To achieve maximum benefits from the residual iron catalyst in the green liquor "dregs" as they are recycled back into the recovery furnace, the temperature of the reaction must be maintained at about 650° C. Since the normal temperature in recovery furnace 12 may range from 810° C. to 820° C., the temperature must be lowered significantly. Accordingly, a temperature depressor in the form of a quantity of alkali metal compounds is added through duct 24 to the spent pulping liquor in advance of the furnace 12. These alkali metal compounds, together with a portion of green liquor dregs being recycled by pump 22, reduce the temperature in the recovery furnace to a more favorable temperature of about 650° C. where a maximum reduction of sodium sulfate to sodium sulfide is effected.

I claim:

1. A Kraft pulping process in which spent pulping liquor bearing inactive alkali sulfates and carbon is subjected to combustion in a recovery furnace to produce inorganic ash and to reduce the alkali sulfates to alkali sulfides, said process comprising the steps of introducing spent pulping liquor to the furnace, burning the spent pulping liquor in the furnace to form a molten smelt, removing the smelt from the furnace and adding said smelt to a quantity of water to produce green liquor containing iron-rich dregs, removing essentially all said dregs from the green liquor to provide a quantity of iron-rich dregs and a quantity of essentially iron-free green liquor, recirculating the essentially iron-free green liquor to a causticizer, dividing the iron-rich dregs into first and second portions, discarding only the first portion of the iron-rich dregs after having removed the valuable constituents therefrom, and directly recycling the second portion of the iron-rich dregs to the recovery furnace by introducing only the second portion of the iron-rich dregs into the spent pulping liquor immediately before introducing the spent pulping liquor into the recovery furnace thereby providing sufficient iron to catalytically reduce the alkali surface therein to alkali sulfide.

2. A Kraft pulping process as defined in claim 1 wherein the second portion of the iron-rich dregs includes sufficient iron that when added to the spent pulping liquor maintains an iron concentration in the smelt formed in the recovery furnace at from 0.05% to 5%.

3. A Kraft pulping process as defined in claim 2, including the addition of a melting point depressor to the spent pulping liquor before the spent pulping liquor is introduced into the recovery furnace to lower the temperature of the smelt formed therein thereby obtaining a maximum reduction of sodium sulfate to sodium sulfide.

4. A Kraft pulping process as defined in claim 3 wherein the melting point depressor is comprised of alkali metal compounds.

5. A Kraft pulping process as defined in claim 4 wherein the melting point depressor of alkali metal compounds and the co-addition of the iron-rich green liquor dregs lowers the temperature of the molten smelt in the recovery furnace to approximately 650° C. and optimizes the catalytic activity of the iron in reducing the sodium sulfate in the spent pulping liquor to sodium sulfide.

* * * * *